US010724206B2

(12) United States Patent
Tsuji

(10) Patent No.: US 10,724,206 B2
(45) Date of Patent: Jul. 28, 2020

(54) WHEEL LOADER

(71) Applicant: KOMATSU LTD., Tokyo (JP)

(72) Inventor: Hideki Tsuji, Komatsu (JP)

(73) Assignee: KOMATSU LTD., Tokyo (JP)

( * ) Notice: Subject to any disclaimer, the term of this patent is extended or adjusted under 35 U.S.C. 154(b) by 323 days.

(21) Appl. No.: 15/563,978

(22) PCT Filed: Jul. 11, 2016

(86) PCT No.: PCT/JP2016/070410
§ 371 (c)(1),
(2) Date: Oct. 3, 2017

(87) PCT Pub. No.: WO2017/033595
PCT Pub. Date: Mar. 2, 2017

(65) Prior Publication Data

US 2018/0142442 A1 May 24, 2018

(30) Foreign Application Priority Data

Aug. 24, 2015 (JP) ..... 2015-164482

(51) Int. Cl.

| | |
|---|---|
| ***E02F 3/43*** | (2006.01) |
| ***E02F 9/20*** | (2006.01) |
| ***E02F 3/28*** | (2006.01) |
| ***E02F 9/22*** | (2006.01) |
| *E02F 9/26* | (2006.01) |

(52) U.S. Cl.
CPC ..... *E02F 3/432* (2013.01); *E02F 3/283* (2013.01); *E02F 9/2029* (2013.01); *E02F 9/2271* (2013.01); *E02F 9/221* (2013.01); *E02F 9/2214* (2013.01); *E02F 9/264* (2013.01)

(58) Field of Classification Search
None
See application file for complete search history.

(56) References Cited

U.S. PATENT DOCUMENTS

| | | | | |
|---|---|---|---|---|
| 2004/0117092 | A1* | 6/2004 | Budde | E02F 3/432 701/50 |
| 2012/0065846 | A1 | 3/2012 | Trombley et al. | |
| 2013/0259620 | A1 | 10/2013 | Shirao | |
| 2014/0107895 | A1 | 4/2014 | Faivre et al. | |
| 2014/0129093 | A1 | 5/2014 | Shirao et al. | |
| 2015/0032287 | A1 | 1/2015 | Duppong et al. | |
| 2016/0040391 | A1 | 2/2016 | Imaizumi et al. | |

(Continued)

FOREIGN PATENT DOCUMENTS

| | | |
|---|---|---|
| CN | 103597256 A | 2/2014 |
| CN | 103975110 A | 8/2014 |
| CN | 104471152 A | 3/2015 |

(Continued)

*Primary Examiner* — John Olszewski
*Assistant Examiner* — Gerrad A Foster
(74) *Attorney, Agent, or Firm* — Faegre Drinker Biddle & Reath LLP

(57) ABSTRACT

A wheel loader includes a vehicular body, a work implement, a front wheel, and a control unit. The work implement is disposed in front of the vehicular body. The work implement has a boom. The front wheel has a tire made of an elastic material. The control unit starts to raise the boom while the tire compressed in a vertical direction rebounds and vertically stretches.

8 Claims, 13 Drawing Sheets

(56) References Cited

U.S. PATENT DOCUMENTS

2016/0155277 A1 6/2016 Asada et al.

FOREIGN PATENT DOCUMENTS

| | | | |
|---|---|---|---|
| EP | 2853641 | A1 | 4/2015 |
| JP | S62-33940 | A | 2/1987 |
| JP | H02-85428 | A | 3/1990 |
| JP | H09-030229 | A | 2/1997 |
| JP | 2008-8183 | A | 1/2008 |
| JP | 2008-133657 | A | 6/2008 |
| JP | 2011-505509 | A | 2/2011 |
| JP | 2015-028477 | A | 2/2015 |
| JP | 5700613 | B1 | 4/2015 |
| WO | WO 2009/073107 | A2 | 6/2009 |
| WO | WO 2015-004809 | A1 | 1/2015 |
| WO | WO 2015/076420 | A1 | 5/2015 |

* cited by examiner

WHEEL LOADER

TECHNICAL FIELD

The present invention relates to a wheel loader.

BACKGROUND ART

A wheel loader representing a mobile work vehicle includes a traveling apparatus for running a vehicle and a work implement for various works such as excavation. The traveling apparatus and the work implement are driven by drive force from an engine.

In general, a wheel loader often simultaneously performs traveling and works. For example, in an excavation work, a work implement is pushed into a heap of soil by moving the vehicle forward and the work implement is raised. The soil is thus scooped in the work implement. Therefore, it is important to allocate power of the engine to the traveling apparatus and the work implement in a balanced manner.

Japanese Patent Laying-Open No. 2008-8183 (PTD 1) and Japanese Patent Laying-Open No. 2008-133657 (PTD 2) have proposed an automatically operated wheel loader of which vehicular body automatically travels toward an excavation object such as soil, of which bucket runs into the excavation object with the traveling operation, and of which bucket and arm are thereafter activated to perform an excavation operation.

CITATION LIST

Patent Document

PTD 1: Japanese Patent Laying-Open No. 2008-8183
PTD 2: Japanese Patent Laying-Open No. 2008-133657

SUMMARY OF INVENTION

Technical Problem

In order to operate the wheel loader such that power of the engine is allocated to the traveling apparatus and the work implement in a balanced manner, skills are required. For example, when an unskilled operator excessively presses an accelerator during excavation and excessively pushes the work implement into soil, the vehicle cannot move forward and is stopped. Since drive force for running the vehicle is excessively large in this state, drive force for raising the work implement is lowered. Therefore, even though a work implement operation member is operated to a maximum extent, the work implement cannot be raised. In such a state that the vehicle stalls, a state that engine power is high continues and fuel efficiency becomes poor (an amount of consumption of fuel increases).

An object of the present invention is to provide a wheel loader capable of achieving improved fuel efficiency in a work for raising a work implement.

Solution to Problem

A wheel loader according to the present invention includes a vehicular body, a work implement, a front wheel, and a control unit. The work implement is disposed in front of the vehicular body. The work implement has a boom. The front wheel has a tire made of an elastic material. The control unit starts to raise the boom while the tire compressed in a vertical direction rebounds and stretches in the vertical direction.

The wheel loader further includes an excavation determination unit. The excavation determination unit determines whether or not excavation is being performed. When it is determined that excavation is being performed, the control unit starts to raise the boom while the tire compressed in the vertical direction rebounds and stretches in the vertical direction.

The wheel loader further includes an angle detection unit. The angle detection unit detects an angle in a pitch direction around a center of gravity of the vehicular body. The control unit starts to raise the boom after the angle detection unit detects start of upward movement of a front portion of the vehicular body with respect to the center of gravity.

The wheel loader further includes a speed detection unit. The speed detection unit detects a speed in a pitch direction around a center of gravity of the vehicular body. The control unit starts to raise the boom while a speed of upward movement of a front portion of the vehicular body with respect to the center of gravity is higher than a threshold value.

In the wheel loader, the work implement further has a bucket. The wheel loader further includes a tilt detection unit which detects a tilt operation of the bucket. The control unit starts to raise the boom after the tilt operation is detected.

The wheel loader further includes an accelerator operation detection unit. The accelerator operation detection unit detects an amount of operation of an accelerator for accelerating the vehicular body. The control unit starts to raise the boom after decrease in the amount of operation of the accelerator is detected.

Advantageous Effects of Invention

According to the wheel loader in the present invention, fuel efficiency in a work for raising a work implement can be improved.

DESCRIPTION OF EMBODIMENTS

An embodiment will be described below with reference to the drawings. Combination of features in the embodiment as appropriate is originally intended. Some constituent elements may not be used.

A wheel loader will be described below with reference to the drawings. In the description below, "up (above)," "down (below)," "front", "rear", "left", and "right" are terms with an operator seated at an operator's seat being defined as the reference.

<Overall Configuration>

Figure 1:
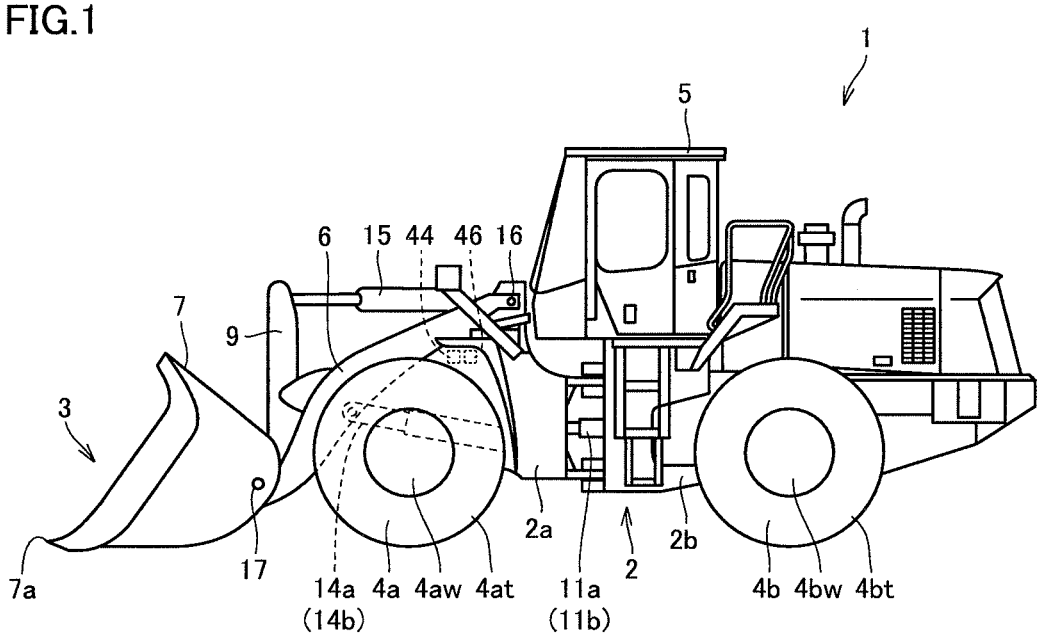
FIG. 1 shows appearance of a wheel loader based on an embodiment.

FIG. 1 shows appearance of a wheel loader 1 based on an embodiment. As shown in FIG. 1, wheel loader 1 includes a vehicular body 2, a work implement 3, wheels 4*a* and 4*b*, and an operator's cab 5. Wheel loader 1 is mobile as wheels 4*a* and 4*b* are rotationally driven, and can perform a desired work with work implement 3.

Vehicular body 2 has a front vehicular body portion 2*a* and a rear vehicular body portion 2*b*. Front vehicular body portion 2*a* and rear vehicular body portion 2*b* are coupled to each other in a manner swingable in a lateral direction.

A pair of steering cylinders 11*a* and 11*b* is provided across front vehicular body portion 2*a* and rear vehicular body portion 2*b*. Steering cylinders 11*a* and 11*b* are hydraulic cylinders driven by a hydraulic oil from a steering pump 12 (see FIG. 2). As steering cylinders 11*a* and 11 *b* extend and contract, front vehicular body portion 2*a* swings with respect to rear vehicular body portion 2*b*. Thus, a direction of travel of wheel loader 1 is changed.

Figure 2:
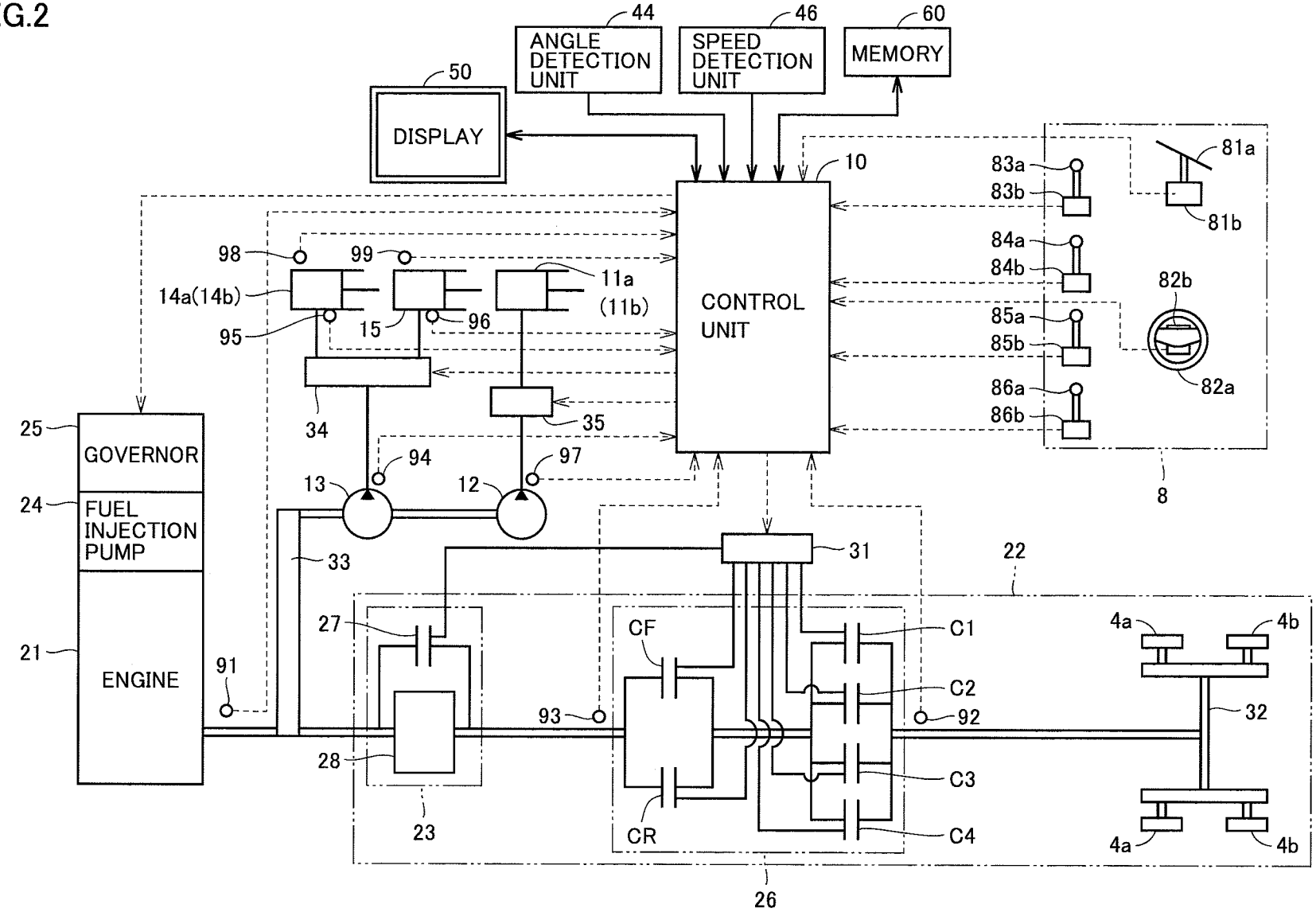
FIG. 2 is a schematic diagram showing a configuration of the wheel loader based on the embodiment.

FIG. 1 and FIG. 2 (which will be described later) show only one of steering cylinders 11*a* and 11*b* and do not show the other.

Work implement 3 and a pair of front wheels 4*a* are attached to front vehicular body portion 2*a*. Work implement 3 is disposed in front of vehicular body 2. Work implement 3 is driven by the hydraulic oil from a work implement pump 13 (see FIG. 2). Work implement 3 includes a boom 6, a pair of lift cylinders 14*a* and 14*b*, a bucket 7, a bell crank 9, and a tilt cylinder 15.

Boom 6 is rotatably supported by front vehicular body portion 2*a*. A base end portion of boom 6 is swingably attached to front vehicular body portion 2*a* by a boom pin 16. Lift cylinders 14*a* and 14*b* have one ends attached to front vehicular body portion 2*a*. Lift cylinders 14*a* and 14*b* have the other ends attached to boom 6. Front vehicular body portion 2*a* and boom 6 are coupled to each other by lift cylinders 14*a* and 14*b*. As lift cylinders 14*a* and 14*b* extend and contract owing to the hydraulic oil from work implement pump 13, boom 6 vertically swings around boom pin 16.

FIGS. 1 and 2 show only one of lift cylinders 14*a* and 14*b* and do not show the other.

Bucket 7 is rotatably supported at a tip end of boom 6. Bucket 7 is swingably supported at a tip end portion of boom 6 by a bucket pin 17. Tilt cylinder 15 has one end attached to front vehicular body portion 2*a*. Tilt cylinder 15 has the other end attached to bell crank 9. Bell crank 9 and bucket 7 are coupled to each other by a not-shown link apparatus. Front vehicular body portion 2*a* and bucket 7 are coupled to each other by tilt cylinder 15, bell crank 9, and the link apparatus. As tilt cylinder 15 extends and contracts owing to the hydraulic oil from work implement pump 13, bucket 7 vertically swings around bucket pin 17.

Operator's cab 5 and a pair of rear wheels 4*b* are attached to rear vehicular body portion 2*b*. Operator's cab 5 is placed on vehicular body 2. A seat where an operator is seated and an operation portion 8 which will be described later are mounted inside operator's cab 5.

Front wheel 4*a* has a wheel portion 4*aw* and a tire 4*at*. Tire 4*at* is attached to an outer circumference of wheel portion 4*aw*. Rear wheel 4*b* has a wheel portion 4*bw* and a tire 4*bt*. Tire 4*bt* is attached to an outer circumference of wheel portion 4*bw*. Tires 4*at* and 4*bt* are made of an elastic material. Tires 4*at* and 4*bt* are made, for example, of rubber.

Front vehicular body portion 2*a* is provided with an angle detection unit 44 and a speed detection unit 46 which will be detailed later.

FIG. 2 is a schematic diagram showing a configuration of wheel loader 1 based on the embodiment. As shown in FIG. 2, wheel loader 1 includes an engine 21 as a drive source, a traveling apparatus 22, work implement pump 13, steering pump 12, operation portion 8, and a control unit 10.

Engine 21 is a diesel engine. Engine 21 has a fuel injection pump 24. Fuel injection pump 24 is provided with an electronic governor 25. Power of engine 21 is controlled by regulating an amount of fuel injected into a cylinder. Such regulation is achieved by control of electronic governor 25 by control unit 10.

Generally, an all speed control type governor is employed as governor 25. Governor 25 regulates an engine speed and an amount of fuel injection in accordance with a load such that an engine speed attains to a target speed in accordance with an amount of operation of an accelerator which will be described later. Governor 25 increases and decreases an amount of fuel injection such that there is no difference between a target speed and an actual engine speed.

An engine speed is detected by an engine speed sensor 91. A detection signal from engine speed sensor 91 is input to control unit 10.

Traveling apparatus 22 is an apparatus for running wheel loader 1 with drive force from engine 21. Traveling apparatus 22 includes a torque converter device 23, a transmission 26, and front wheel 4*a* and rear wheel 4*b* described above.

Torque converter device 23 includes a lock-up clutch 27 and a torque converter 28. Lock-up clutch 27 is a hydraulically activated clutch. Lock-up clutch 27 can switch between a coupled state and a decoupled state as control unit 10 controls supply of the hydraulic oil to lock-up clutch 27 with a clutch control valve 31 being interposed. While lock-up clutch 27 is in the decoupled state, torque converter 28 transmits drive force from engine 21 with an oil serving as a medium. While lock-up clutch 27 is in the coupled state, an input side and an output side of torque converter 28 are directly coupled to each other.

Transmission 26 includes a forward clutch CF corresponding to a forward drive gear and a reverse clutch CR corresponding to a reverse drive gear. With switching between a coupled state and a decoupled state of each of clutches CF and CR, switching between forward drive and reverse drive of the vehicle is made. While both of clutches CF and CR are in the decoupled state, the vehicle is in a neutral state.

Transmission 26 includes a plurality of velocity stage clutches C1 to C4 corresponding to a plurality of velocity stages and can change a reduction gear ratio in a plurality of stages. Each of velocity stage clutches C1 to C4 is a hydraulically activated hydraulic clutch. The hydraulic oil is supplied from a not-shown hydraulic pump through clutch control valve 31 to clutches C1 to C4. Clutch control valve 31 is controlled by control unit 10 to control supply of the hydraulic oil to clutches C1 to C4, so that switching between the coupled state and the decoupled state of each of clutches C1 to C4 is made.

An output shaft of transmission 26 is provided with a T/M output speed sensor 92. T/M output speed sensor 92 detects a speed of the output shaft of transmission 26. A detection signal from T/M output speed sensor 92 is input to control unit 10. Control unit 10 calculates a vehicle speed based on a detection signal from T/M output speed sensor 92.

An input shaft of transmission 26 is provided with a T/M input speed sensor 93. T/M input speed sensor 93 detects a speed of the input shaft of transmission 26. A detection signal from T/M input speed sensor 93 is input to control unit 10.

Drive force output from transmission 26 is transmitted to wheels 4*a* and 4*b* through a shaft 32. Wheel loader 1 thus travels. Some of drive force from engine 21 is transmitted to traveling apparatus 22 so that wheel loader 1 travels.

Some of drive force from engine 21 is transmitted to work implement pump 13 and steering pump 12 through a power take off (PTO) shaft 33. Work implement pump 13 and steering pump 12 are hydraulic pumps driven by drive force from engine 21. The hydraulic oil delivered from work implement pump 13 is supplied to lift cylinders 14*a* and 14*b* and tilt cylinder 15 through a work implement control valve 34. The hydraulic oil delivered from steering pump 12 is supplied to steering cylinders 11*a* and 11*b* through a steering control valve 35. Work implement 3 is driven by some of drive force from engine 21.

A pressure of the hydraulic oil delivered from work implement pump 13 is detected by a first hydraulic sensor 94. A pressure of the hydraulic oil supplied to lift cylinders 14*a* and 14*b* is detected by a second hydraulic sensor 95. Specifically, second hydraulic sensor 95 detects a hydraulic pressure in a cylinder bottom chamber to which the hydraulic oil is supplied when lift cylinders 14*a* and 14*b* extend. A pressure of the hydraulic oil supplied to tilt cylinder 15 is detected by a third hydraulic sensor 96. Specifically, third hydraulic sensor 96 detects a hydraulic pressure in a cylinder bottom chamber to which the hydraulic oil is supplied when tilt cylinder 15 extends. A pressure of the hydraulic oil delivered from steering pump 12 is detected by a fourth hydraulic sensor 97. Detection signals from first to fourth hydraulic sensors 94 to 97 are input to control unit 10.

Operation portion 8 is operated by an operator. Operation portion 8 includes an accelerator operation member 81*a*, an accelerator operation detection unit 81*b*, a steering operation member 82*a*, a steering operation detection unit 82*b*, a boom operation member 83*a*, a boom operation detection unit 83*b*, a bucket operation member 84*a*, a bucket operation detection unit 84*b*, a transmission operation member 85*a*, a transmission operation detection unit 85*b*, an FR operation member 86*a*, and an FR operation detection unit 86*b*.

Accelerator operation member 81*a* is operated in order to set a target speed of engine 21. Accelerator operation member 81*a* is implemented, for example, by an accelerator pedal. When an amount of operation of accelerator operation member 81*a* (in an example of an accelerator pedal, an amount of pressing) is increased, the vehicular body is accelerated. When an amount of operation of accelerator operation member 81*a* is decreased, the vehicular body is decelerated. Accelerator operation detection unit 81*b* detects an amount of operation of accelerator operation member 81*a*. An amount of operation of accelerator operation member 81*a* is referred to as an amount of operation of the accelerator. Accelerator operation detection unit 81*b* detects the amount of operation of the accelerator. Accelerator operation detection unit 81*b* outputs a detection signal to control unit 10.

Steering operation member 82*a* is operated in order to operate a direction of travel of a vehicle. Steering operation member 82*a* is implemented, for example, by a steering wheel. Steering operation detection unit 82*b* detects a position of steering operation member 82*a* and outputs a detection signal to control unit 10. Control unit 10 controls steering control valve 35 based on a detection signal from steering operation detection unit 82*b*. Thus, steering cylinders 11*a* and 11*b* extend and contract and a direction of travel of the vehicle is changed.

Boom operation member 83*a* is operated in order to operate boom 6. Bucket operation member 84*a* is operated in order to operate bucket 7. Boom operation member 83*a* and bucket operation member 84*a* are each implemented, for example, by an operation lever. Boom operation detection unit 83*b* detects a position of boom operation member 83*a*. Bucket operation detection unit 84*b* detects a position of bucket operation member 84*a*. Boom operation detection unit 83*b* and bucket operation detection unit 84*b* output detection signals to control unit 10. Control unit 10 controls work implement control valve 34 based on detection signals from boom operation detection unit 83*b* and bucket operation detection unit 84*b*. Thus, lift cylinders 14*a* and 14*b* and tilt cylinder 15 extend and contract and boom 6 and bucket 7 operate.

Figure 3:
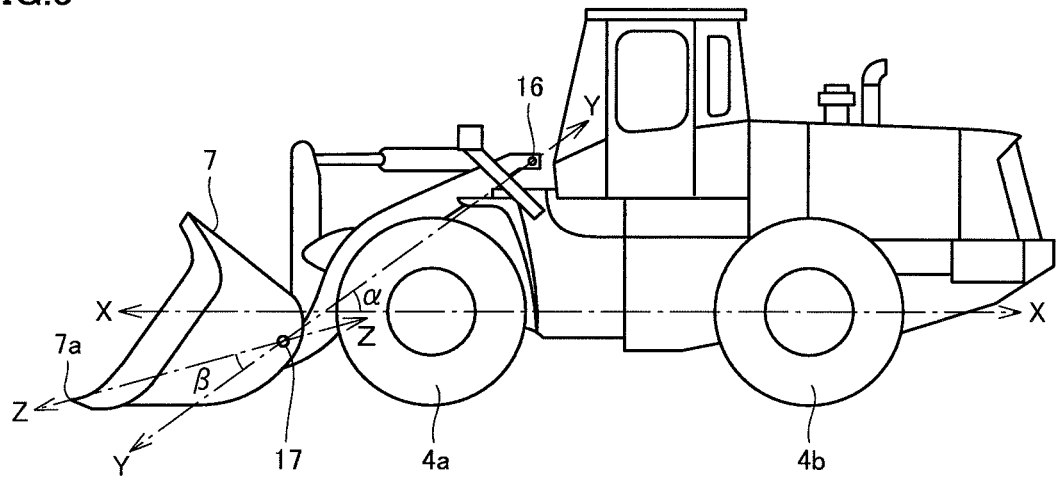
FIG. 3 is a side view of the wheel loader in which a boom angle and a tilt angle are shown.

Work implement 3 is provided with a boom angle detection unit 98 which detects a boom angle and a tilt angle detection unit 99 which detects a tilt angle. FIG. 3 is a side view of wheel loader 1 in which a boom angle $\alpha$ and a tilt angle $\beta$ are shown. The X-X line shown in FIG. 3 is a line connecting axial centers of front and rear wheels 4*a* and 4*b* to each other. The Y-Y line is a line connecting boom pin 16 serving as the center of pivotal support of front vehicular body portion 2*a* and boom 6 and bucket pin 17 serving as the center of pivotal support of boom 6 and bucket 7 to each other. The Z-Z line is a line connecting bucket pin 17 and a cutting edge 7*a* of bucket 7 to each other.

Boom angle $\alpha$ refers to an angle lying between the X-X line and the Y-Y line. Boom 6 pivots around boom pin 16 relatively to front vehicular body portion 2*a*, and boom angle $\alpha$ represents an angle of pivot of boom 6 relative to front vehicular body portion 2*a*. Tilt angle $\beta$ refers to an angle lying between the Y-Y line and the Z-Z line. Bucket 7 pivots around bucket pin 17 relatively to boom 6, and tilt angle $\beta$ represents an angle of pivot of bucket 7 relative to boom 6.

Referring again to FIG. 2, boom angle detection unit 98 and tilt angle detection unit 99 output detection signals to control unit 10. Control unit 10 calculates a current position of bucket 7 based on boom angle α and tilt angle β.

Transmission operation member 85*a* is operated in order to set a velocity stage of transmission 26. Transmission operation member 85*a* is implemented, for example, by a shift lever. Transmission operation detection unit 85*b* detects a position of transmission operation member 85*a*. Transmission operation detection unit 85*b* outputs a detection signal to control unit 10. Control unit 10 controls speed change by transmission 26 based on a detection signal from transmission operation detection unit 85*b*.

FR operation member 86*a* is operated to switch between forward drive and reverse drive of the vehicle. FR operation member 86*a* is set to each of a forward drive position, a neutral position, and a reverse drive position. FR operation detection unit 86*b* detects a position of FR operation member 86*a*. FR operation detection unit 86*b* outputs a detection signal to control unit 10. Control unit 10 controls clutch control valve 31 based on a detection signal from FR operation detection unit 86*b*. Forward clutch CF and reverse clutch CR are thus controlled so that switching among forward drive, reverse drive, and the neutral state of the vehicle is made.

Control unit 10 is generally implemented by reading of various programs by a central processing unit (CPU).

Control unit 10 is connected to a memory 60. Memory 60 functions as a work memory and stores various programs for implementing functions of the wheel loader.

Control unit 10 sends an engine command signal to governor 25 in order to obtain a target speed in accordance with an amount of operation of accelerator operation member 81*a*.

Control unit 10 is connected to angle detection unit 44. Angle detection unit 44 is provided in front vehicular body portion 2*a* as shown in FIG. 1. Angle detection unit 44 detects a pitch angle of vehicular body 2 and provides an input of a detection signal to control unit 10. A direction around an axis which passes through the center of gravity of wheel loader 1 and extends in a lateral direction is referred to as a pitch direction. The pitch direction refers to a direction in which a front end of vehicular body 2 is lowered or raised with respect to the center of gravity of vehicular body 2. A pitch angle refers to an angle of inclination of vehicular body 2 in the pitch direction. The pitch angle refers to an angle of inclination in a fore-aft direction of vehicular body 2 with respect to a reference plane in a vertical direction or a horizontal direction.

Control unit 10 is connected to speed detection unit 46. Speed detection unit 46 is provided in front vehicular body portion 2*a* as shown in FIG. 1. Speed detection unit 46 detects a speed in the pitch direction of vehicular body 2 and provides an input of a detection signal to control unit 10. Speed detection unit 46 detects a speed of downward or upward movement of the front end of vehicular body 2 with respect to the center of gravity of vehicular body 2.

Control unit 10 is also connected to a display 50. Display 50 is provided with such an input device as a touch panel, and a command can be given to control unit 10 by operating the touch panel. Display 50 can show operation guidance to an operator.

<Excavation Work>

Figure 4:
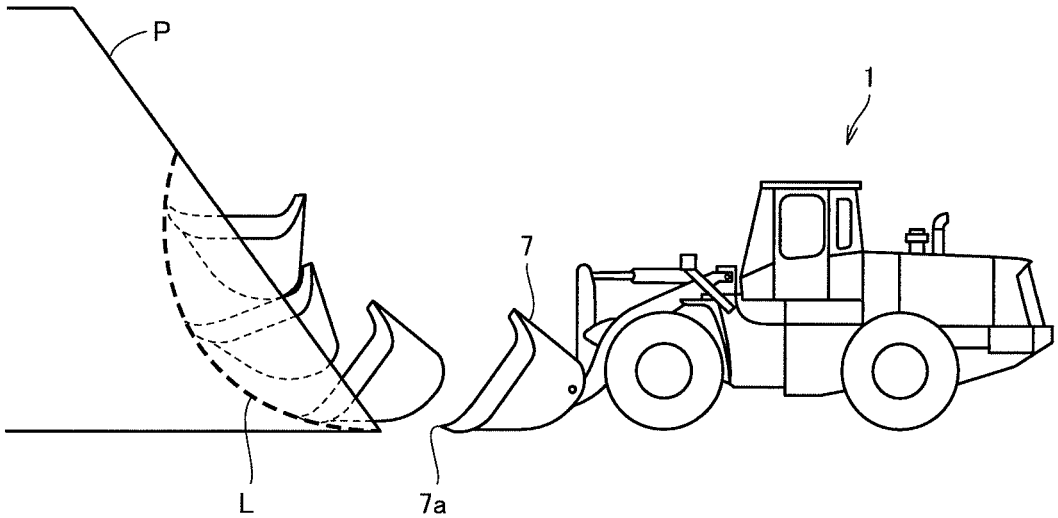
FIG. 4 illustrates an excavation work by the wheel loader based on the embodiment.

Wheel loader 1 in the present embodiment performs an excavation work for scooping an excavated object such as soil. FIG. 4 illustrates an excavation work by wheel loader 1 based on the embodiment.

As shown in FIG. 4, wheel loader 1 pushes cutting edge 7*a* of bucket 7 into an excavated object P and thereafter raises bucket 7 along a bucket trace L. The excavation work for scooping excavated object P is thus performed.

Figure 5:
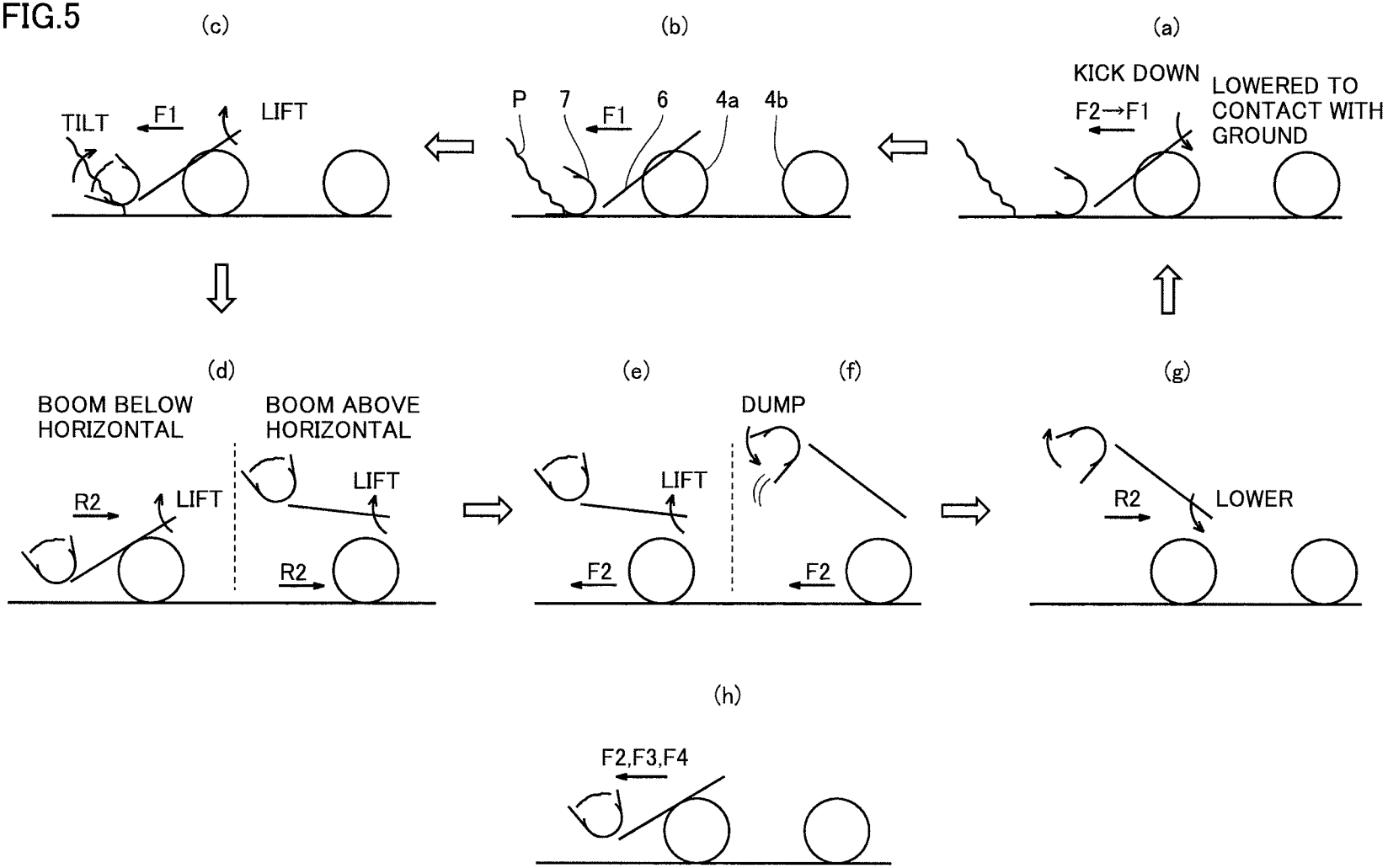
FIG. 5 is a schematic diagram showing an example of a series of steps included in an excavation work and a loading work by the wheel loader.

FIG. 5 is a schematic diagram showing an example of a series of steps included in an excavation work and a loading work by wheel loader 1. Wheel loader 1 excavates excavated object P and loads excavated object P on a transportation machine such as a dump truck by successively repeating a plurality of steps as follows.

In a forward travel step shown in FIG. 5 (*a*), an operator operates lift cylinders 14*a* and 14*b* and tilt cylinder 15 to set work implement 3 to an excavation attitude in which boom 6 is located at a low position and bucket 7 is horizontally oriented, and moves wheel loader 1 forward toward excavated object P.

In an excavation step shown in FIGS. 5 (*b*) and (*c*), the operator moves wheel loader 1 further forward and pushes cutting edge 7*a* of bucket 7 into the excavated object (a pushing sub step shown in FIG. 5 (*b*)). Thereafter, the operator operates tilt cylinder 15 to tilt back bucket 7 and scoops excavated object P into bucket 7 (a scooping sub step shown in FIG. 5 (*c*)). Depending on a type of excavated object P, the scooping sub step may be completed simply by tilting back bucket 7 once. Alternatively, in the scooping sub step, an operation to tilt back bucket 7, set the bucket to a neutral position, and tilt back the bucket again may be repeated.

After excavated object P is scooped into bucket 7, in a rearward travel∩boom raising step shown in FIG. 5 (*d*), the operator raises boom 6 by extending lift cylinders 14*a* and 14*b* while the operator moves wheel loader 1 rearward.

In a forward travel-boom raising step shown in FIG. 5 (*e*), the operator further extends lift cylinders 14*a* and 14*b* and raises boom 6 until a height of bucket 7 attains to a loading height while the operator moves wheel loader 1 forward to come closer to the dump truck.

In a soil ejection step shown in FIG. 5 (*f*), the operator dumps the excavated object from bucket 7 at a prescribed position and loads excavated object P on a box of the dump truck. This step is often performed continuously from the preceding forward travel•boom raising step while the wheel loader moves forward.

In a rearward travel•boom lowering step shown in FIG. 5 (*g*), the operator lowers boom 6 and returns bucket 7 to the excavation attitude while the operator moves the vehicle rearward.

The above is typical steps defining one cycle of the excavation and loading works.

FIG. 5 (*h*) further shows a simple traveling step in which wheel loader 1 simply travels. In this step, the operator moves wheel loader 1 forward with boom 6 being located at a low position. The wheel loader may carry a load with bucket 7 being loaded or may travel without bucket 7 being loaded.

Figure 6:
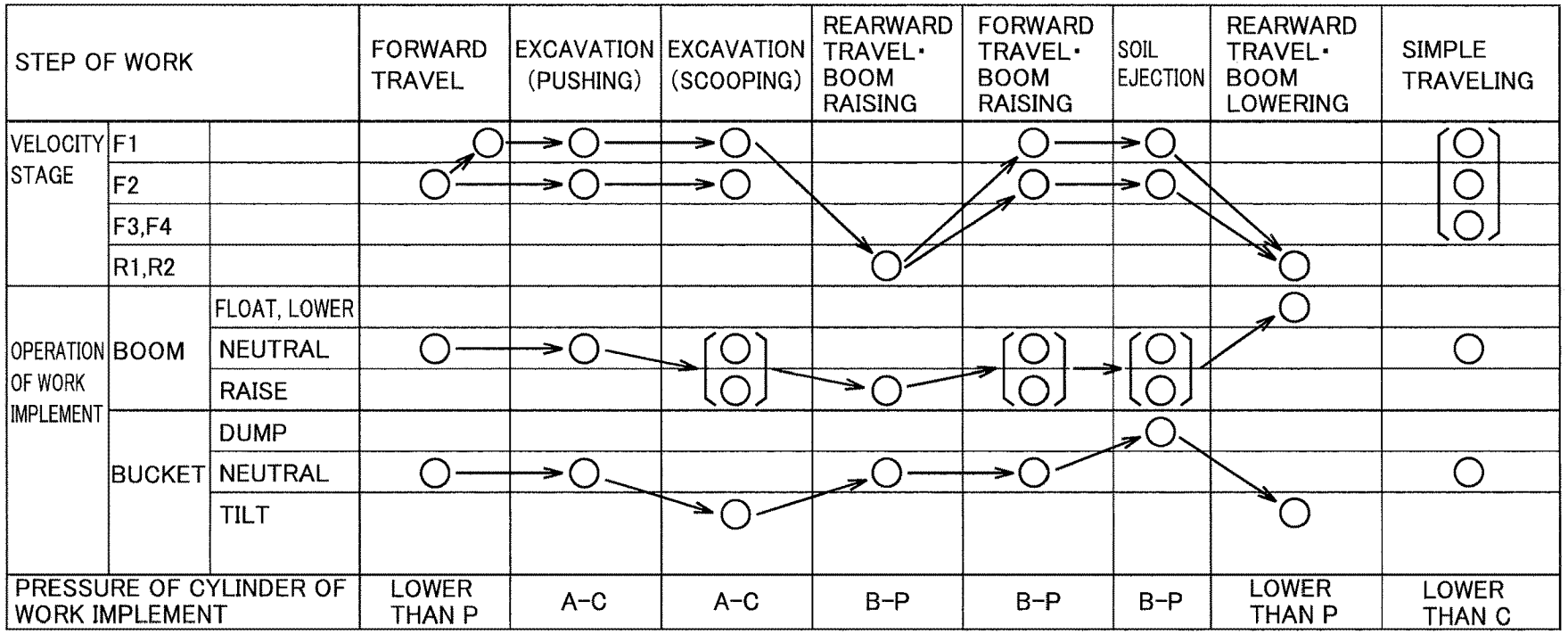
FIG. 6 shows a table showing a determination method in the series of steps included in the excavation work and the loading work by the wheel loader.

FIG. 6 shows a table showing a determination method in the series of steps included in the excavation work and the loading work by wheel loader 1.

In the table shown in FIG. 6, a row of "step of work" at the top lists names of steps of the work shown in FIG. 5 (*a*) to (*h*). In rows of "velocity stage," "operation of work implement," and "pressure of cylinder of work implement" below, various criteria used by control unit 10 for determining what a current step is are shown.

More specifically, in the row of "velocity stage," criteria for a velocity stage of transmission 26 are shown with a circle. An example in which transmission 26 has four forward drive velocity stages F1 to F4 and two reverse drive velocity stages R1 and R2 is assumed.

In the row of "operation of work implement," criteria for an operation by an operator onto work implement 3 are shown with a circle. More specifically, in a row of "boom", criteria for an operation of boom 6 are shown, and in a row of "bucket", criteria for an operation of bucket 7 are shown.

In the row of "pressure of cylinder of work implement," criteria for a current hydraulic pressure of the cylinder of work implement 3 such as a hydraulic pressure of a cylinder bottom chamber of lift cylinders 14*a* and 14*b* are shown. Four reference values A, B, C, and P are set in advance for a hydraulic pressure, a plurality of pressure ranges (a range lower than reference value P, a range of reference values A to C, a range of reference values B to P, and a range lower than reference value C) are defined by reference values A, B, C, and P, and these pressure ranges are set as the criteria. Magnitude of four reference values A, B, C, and P is defined as A>B>C>P.

By using a combination of criteria for "velocity stage," "boom", "bucket", and "pressure of cylinder of work implement" for each step as above, control unit 10 determines what a currently performed step is.

A specific operation of control unit 10 when control shown in FIG. 6 is carried out will be described below.

A combination of criteria for "velocity stage," "boom", "bucket", and "pressure of cylinder of work implement" corresponding to each step shown in FIG. 6 is stored in advance in memory 60. Control unit 10 recognizes a currently selected velocity stage (F1 to F4, R1, or R2) of transmission 26 based on signals from transmission operation detection unit 85*b* and FR operation detection unit 86*b* shown in FIG. 2. Control unit 10 recognizes a type of a current operation of boom 6 (float, lowering, neutral, or raising) based on a signal from boom operation detection unit 83*b*. Control unit 10 recognizes a type of a current operation of bucket 7 (dump, neutral, or tilt) based on a signal from bucket operation detection unit 84*b*. Control unit 10 recognizes a current hydraulic pressure of the cylinder bottom chamber of lift cylinders 14*a* and 14*b* based on a signal from second hydraulic sensor 95 shown in FIG. 2.

Control unit 10 compares the combination of the recognized current velocity stage, the type of the operation of the boom, the type of the operation of the bucket, and the hydraulic pressure of the lift cylinder (that is, a current state of work) with the combination of the criteria for "velocity stage," "boom", "bucket", and "pressure of cylinder of work implement" corresponding to each step stored in advance. As a result of this comparison processing, control unit 10 determines to which step the combination of criteria which matches best with the current state of work corresponds.

The combination of criteria corresponding to the excavation step shown in FIG. 6 is specifically as follows.

In the excavation step (pushing sub step), the velocity stage is set to F1 or F2, the operation of the boom and the operation of the bucket are both neutral, and the pressure of the cylinder of the work implement is within the range of reference values A to C.

In the excavation step (scooping sub step), the velocity stage is set to F1 or F2, the operation of the boom is raising or neutral, the operation of the bucket is tilt, and the pressure of the cylinder of the work implement is within the range of reference values A to C. For an operation of the bucket, such a criterion that tilt and neutral are alternately repeated may further be added because, depending on a state of excavated object P, an operation to tilt back bucket 7, set the bucket to a neutral position, and tilt back the bucket again may be repeated.

Figure 7:
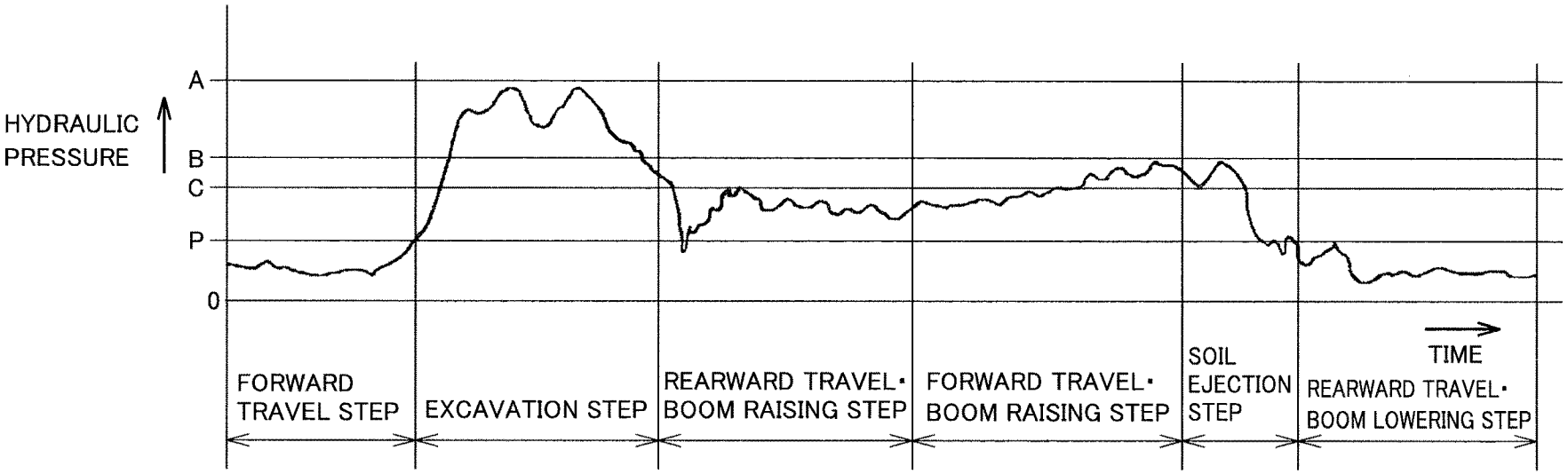
FIG. 7 shows a graph showing one example of variation in hydraulic pressure of a lift cylinder during the excavation work and the loading work by the wheel loader.

FIG. 7 shows a graph showing one example of variation in hydraulic pressure of lift cylinders 14*a* and 14*b* during the excavation work and the loading work by wheel loader 1. In FIG. 7, the ordinate represents a hydraulic pressure of lift cylinders 14*a* and 14*b* and the abscissa represents time. FIG. 7 shows a hydraulic pressure of the cylinder bottom chamber of lift cylinders 14*a* and 14*b* in each step shown in FIGS. 5 and 6.

As shown in FIG. 7, the hydraulic pressure of lift cylinders 14*a* and 14*b* is low in the forward travel step, it abruptly significantly increases as the excavation step is started, it is continually high in the entire section of the excavation step, and it suddenly significantly lowers when the excavation step ends. The hydraulic pressure of lift cylinders 14*a* and 14*b* is lower than reference value P in the entire section of the forward travel step whereas it is significantly higher than reference value P in the entire section of the excavation step, and a difference is thus clear.

A duration of the forward travel step is normally approximately several seconds (for example, five seconds). Therefore, when a hydraulic pressure of lift cylinders 14*a* and 14*b* being lower than prescribed reference value P for a prescribed period of time (for example, one second), following increase in hydraulic pressure, and a time point when the hydraulic pressure exceeds reference value P are detected, that time point can be sensed as a time point of start of the excavation step.

As a velocity stage is changed from forward drive to a neutral position or reverse drive after the excavation step is started, determination as end of the excavation step can be made based on change in velocity stage of transmission 26 shown in FIG. 6. Alternatively, by detecting the fact that a hydraulic pressure of lift cylinders 14*a* and 14*b* becomes lower than reference value B after start of the excavation step and is kept lower than reference value B for a prescribed period of time (for example, one second), determination as end of the excavation step can be made based on variation in hydraulic pressure of lift cylinders 14*a* and 14*b* shown in FIG. 7.

As described above, control unit 10 can determine whether or not the current step is the excavation step mainly based on a state of a hydraulic pressure of lift cylinders 14*a* and 14*b*. Instead of or together with a hydraulic pressure of lift cylinders 14*a* and 14*b*, a hydraulic pressure of the cylinder bottom chamber of tilt cylinder 15 may be used for determination as to whether or not the excavation step is being performed. Any or a combination of a velocity stage of transmission 26, a position of work implement 3, and a vehicle traveling speed may be used for determination as to whether or not the excavation step is being performed.

<Concept of Control During Excavation Work>

Figure 8:
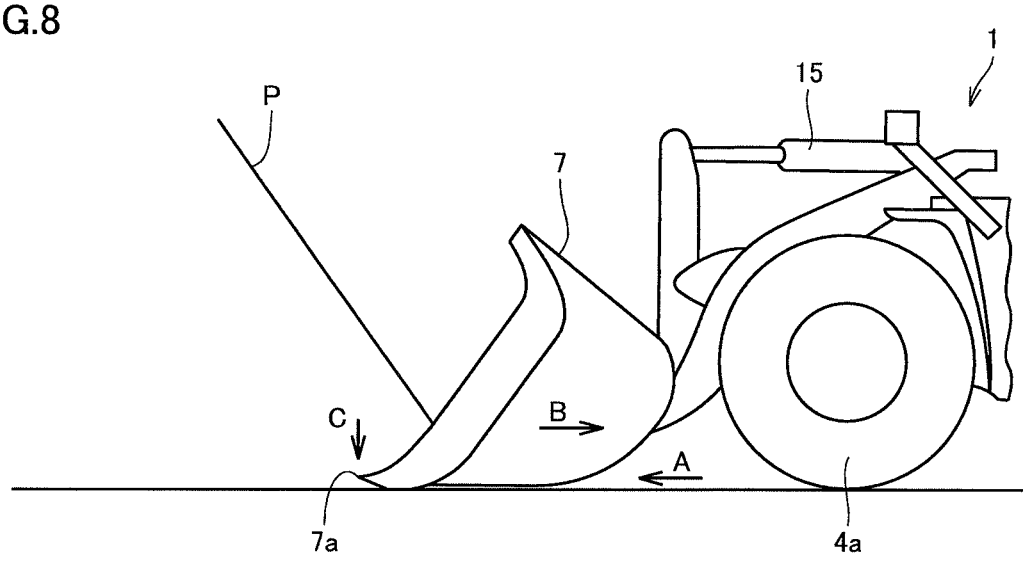
FIG. 8 is a side view showing a state that the wheel loader has started excavation of an excavated object.

A behavior of wheel loader 1 in the excavation step and control for raising boom 6 in the excavation step will be described below. FIG. 8 is a side view showing a state that wheel loader 1 has started excavation of excavated object P.

As shown in FIG. 8, wheel loader 1 moves forward in a direction shown with an arrow A and sticks cutting edge 7*a* of bucket 7 into excavated object P. Repulsive force is applied to bucket 7 in a direction shown with an arrow B which is opposite to the direction shown with arrow A. In addition, as excavated object P is introduced in bucket 7, force is applied to bucket 7 also in a direction shown with an arrow C under the influence by gravity applied to excavated object P.

Figure 9:
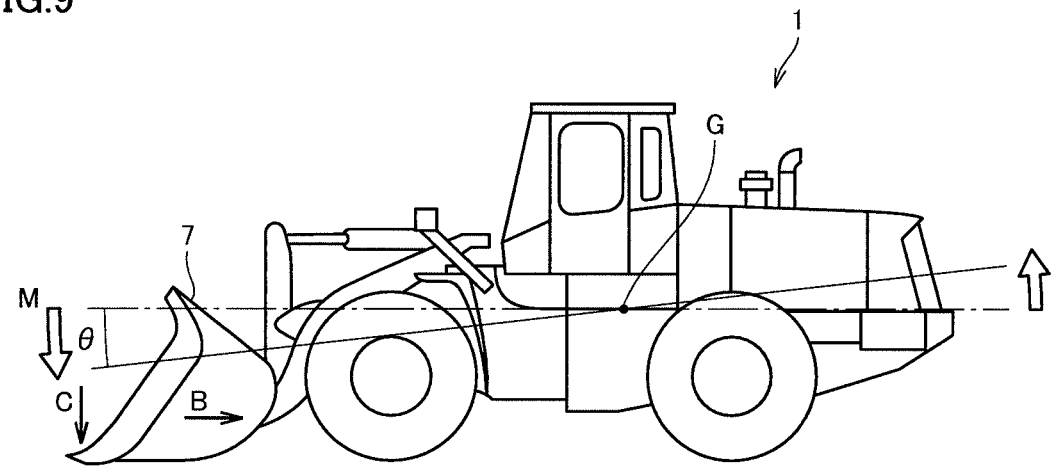
FIG. 9 is a side view showing inclination of the wheel loader at the time of start of excavation.

FIG. 9 is a side view showing inclination of wheel loader 1 at the time of start of excavation. A black circle shown in FIG. 9 represents a center of gravity G of vehicular body 2 of wheel loader 1. A chain dotted line shown in FIG. 9 shows a straight line which passes through center of gravity G and extends in parallel to the ground. When wheel loader 1 travels over the horizontal ground, the chain dotted line shown in FIG. 9 represents the horizontal plane. FIG. 9 also shows arrow B and arrow C indicating directions of forces applied to bucket 7 described with reference to FIG. 8.

As forces in the directions shown with arrow B and arrow C are applied to bucket 7, a moment M around center of gravity G of vehicular body 2 shown with a hollow arrow in FIG. 9 is generated. With this moment M, downward force is applied to the front end of vehicular body 2 of wheel loader 1. Vehicular body 2 is thus inclined forward. Vehicular body 2 is inclined along the pitch direction described above. The front end of vehicular body 2 moves downward with respect to center of gravity G. With inclination of vehicular body 2, a pitch angle θ shown in FIG. 9 is generated.

Since tire 4 at of front wheel 4*a* is made of an elastic material, tire 4*at* elastically deforms as being vertically compressed. As front wheel 4*a* is compressed and contracts, vehicular body 2 is inclined with pitch angle θ being formed with respect to center of gravity G. In a left side view of wheel loader 1 shown in FIG. 9, vehicular body 2 is displaced counterclockwise around center of gravity G.

Figure 10:
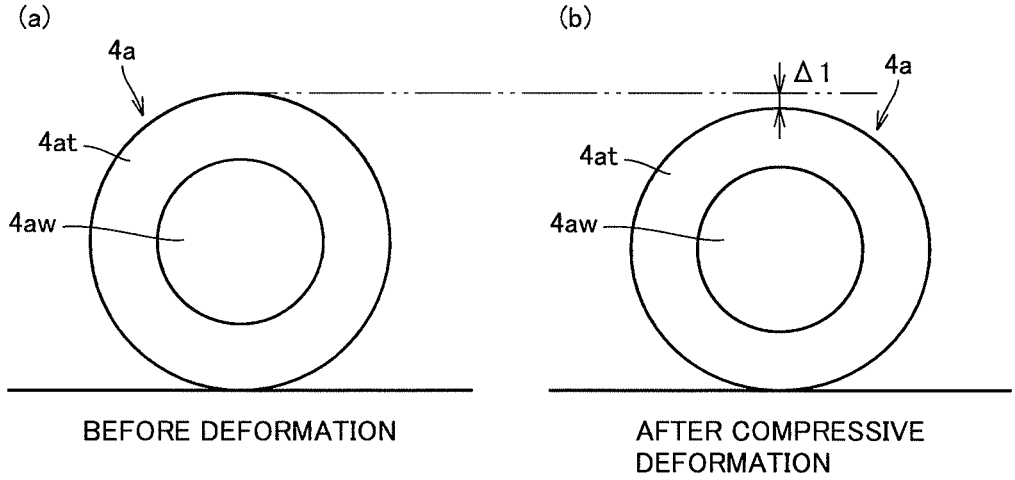
FIG. 10 is a schematic diagram showing compressive deformation of a tire.

FIG. 10 is a schematic diagram showing compressive deformation of tire 4*at*. FIG. 10 (*a*) is a diagram schematically showing front wheel 4*a* which is not compressed and has not deformed, and (b) is a diagram schematically showing front wheel 4*a* which has deformed as being vertically compressed.

FIG. 10 (*a*) schematically shows wheel portion 4*aw* and tire 4*at* of front wheel 4*a* with concentric circles. Since wheel portion 4*aw* is made of a metal material, it does not deform even when vehicular body 2 is inclined in the pitch direction. Therefore, FIG. 10 (*b*) shows wheel portion 4*aw* in a circular shape as in FIG. 10 (*a*). Since tire 4*at* is made of an elastic material such as rubber, as a result of inclination forward of vehicular body 2, the tire elastically deforms. In FIG. 10 (*b*), tire 4*at* is deflected as being vertically compressed. As compared with the tire in FIG. 10 (*a*), tire 4*at* shown in FIG. 10 (*b*) is smaller in vertical dimension orthogonal to the ground surface by a dimension Δ1 shown in the figure.

Figure 11:
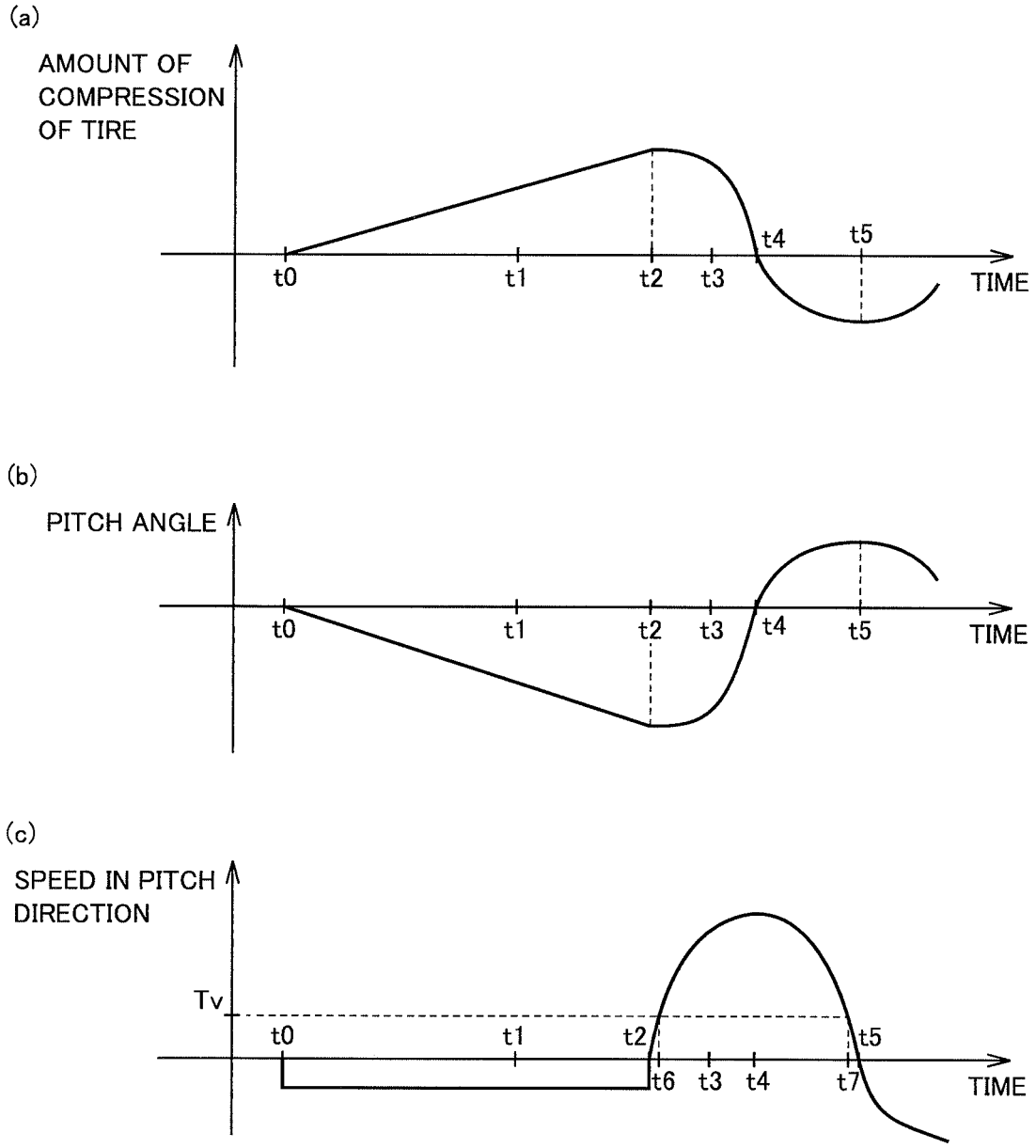
FIG. 11 shows a graph showing relation of an amount of compression of a tire, a pitch angle, and a speed of movement of a vehicular body in a pitch direction with time.

FIG. 11 shows a graph showing relation of an amount of compression of tire 4*at*, pitch angle θ, and a speed of movement of vehicular body 2 in the pitch direction with time. The abscissa in FIG. 11 (*a*) represents time and the ordinate represents an amount of compression of tire 4*at* in the vertical direction. A positive direction on the ordinate in FIG. 11 (*a*) represents a state that tire 4*at* is compressed in the vertical direction and a negative direction represents a state that tire 4*at* stretches in the vertical direction.

The abscissa in FIG. 11 (*b*) represents time and the ordinate represents pitch angle θ. The positive direction on the ordinate in FIG. 11 (*b*) represents a state that the front end of vehicular body 2 is displaced upward with respect to center of gravity G and the negative direction represents a state that the front end of vehicular body 2 is displaced downward with respect to center of gravity G. The positive direction on the ordinate in FIG. 11 (*b*) represents an angle of elevation and the negative direction represents an angle of depression.

The abscissa in FIG. 11 (*c*) represents time and the ordinate represents a speed at which vehicular body 2 moves in the pitch direction. The positive direction on the ordinate in FIG. 11 (*c*) represents upward movement of the front end of vehicular body 2 and the negative direction represents downward movement of the front end of vehicular body 2.

Time t0 shown on a time axis in FIGS. 11 (*a*), (*b*), and (*c*) is time at which compression of tire 4*at* starts, pitch angle θ in an orientation downward with respect to center of gravity G is generated, and generation of a speed in a downward direction in the pitch direction starts. Time t1 is time during increase in amount of compression of tire 4*at* and during increase in pitch angle θ in the orientation downward with respect to center of gravity G. Time t2 is time at which the amount of compression of tire 4*at* attains to the maximum and pitch angle θ in the orientation downward with respect to center of gravity G attains to the maximum.

In the present embodiment, an amount of compression of a tire and an increment in pitch angle per unit time are assumed as constant. Therefore, while tire 4*at* is compressed (from time t0 to time t2), a speed in the downward direction in the pitch direction is constant. Without being limited as such, a speed in the pitch direction may gradually decrease with lapse of time from time t0 to time t2.

At time t2, a tilt operation to tilt back bucket 7 (see FIG. 5 (*c*)) is started. Alternatively, at time t2, the amount of operation of the accelerator for accelerating wheel loader 1 in the direction shown with arrow A in FIG. 8 is decreased. Since a component of force applied to bucket 7 in the direction shown with arrow B in FIG. 8 consequently decreases, moment M around center of gravity G of vehicular body 2 shown in FIG. 9 decreases. Compression in the vertical direction of tire 4*at* of front wheel 4*a* is thus released. Tire 4*at* of which compression has been released rebounds and stretches in the vertical direction.

Therefore, the amount of compression of tire 4*at* shown in FIG. 11 (*a*) linearly increases from time t0 to time t2, and stops increasing and starts to decrease at time t2.

As shown in FIG. 11 (*b*), pitch angle θ in the orientation downward with respect to center of gravity G linearly increases from time t0 to time t2, and stops increasing and starts to decrease at time t2. In the left side view shown in FIG. 9, displacement counterclockwise around center of gravity G of vehicular body 2 increases from time t0 to time t2, and at time t2, such increase stops and vehicular body 2 starts to move clockwise around center of gravity G. From time t0 to time t2, the front portion of vehicular body 2 moves downward with respect to the center of gravity. At time t2, the front portion of vehicular body 2 starts to move upward.

As shown in FIG. 11 (*c*), while tire 4*at* is compressed (from time t0 to time t2), the front end of vehicular body 2 moves in the pitch direction with the speed in the downward direction being kept constant. At time t2, a direction of movement of the front end of vehicular body 2 changes from the downward direction to an upward direction.

Time t3 shown on the time axis in FIGS. 11 (*a*), (*b*), and (*c*) is time during decrease in amount of compression of tire 4*at*, upward movement of the front end of vehicular body 2 in the pitch direction, and decrease in pitch angle θ in the orientation downward with respect to center of gravity G.

Time t4 is time at the moment when the amount of compression of tire 4*at* attains to zero. At time t4, pitch angle θ of vehicular body 2 also attains to zero. At time t4, a speed of upward movement of the front end of vehicular body 2 attains to the maximum.

Since tire 4*at* is made of an elastic material, it vibrates. Tire 4*at* does not stop immediately after the amount of compression in the vertical direction attains to zero at time t4 but it stretches in the vertical direction after time t4. Time t5 is time at which an amount of stretch of tire 4*at* attains to the maximum and pitch angle θ in an orientation upward with respect to center of gravity G attains to the maximum. At time t5, the direction of movement of the front end of vehicular body 2 changes from the upward direction to the downward direction.

Therefore, as shown in FIG. 11 (*a*), the amount of compression in the vertical direction of tire 4*at* decreases from time t2 to time t4 and tire 4*at* stretches in the vertical direction from time t4 to time t5. With release of compressive force, tire 4*at* compressed in the vertical direction from time t0 to time t2 rebounds and stretches in the vertical direction from time t2 to time t5.

As shown in FIG. 11 (*b*), vehicular body 2 is inclined with pitch angle θ in the orientation downward with respect to the center of gravity being formed from time t0 to time t4. With stretching of tire 4*at* after time t4, vehicular body 2 is inclined with pitch angle θ in the orientation upward with respect to center of gravity G being formed.

As shown in FIG. 11 (*c*), while tire 4*at* stretches (from time t2 to time t5), the front end of vehicular body 2 moves in the pitch direction at a speed in the upward direction.

A prescribed threshold value Tv for a speed in the pitch direction of vehicular body 2 is shown on the ordinate in FIG. 11 (*c*). Time t6 shown on the abscissa in FIG. 11 (*c*) is time at the moment when the speed in the upward direction in the pitch direction of vehicular body 2 increases and attains to threshold value Tv or higher. Time t7 is time at the movement when the speed in the upward direction in the pitch direction of vehicular body 2 decreases and attains to threshold value Tv or lower. From time t6 to time t7, the speed in the upward direction in the pitch direction of vehicular body 2 is equal to or higher than threshold value Tv. During a period after time t6 until time t7, the speed of upward movement of the front portion of vehicular body 2 with respect to center of gravity G is higher than threshold value Tv.

Referring back to FIG. 10, FIG. 10 (*a*) shows a state of tire 4*at* before time t0. FIG. 10 (*b*) shows a state of tire 4*at* at time t1.

Figure 12:
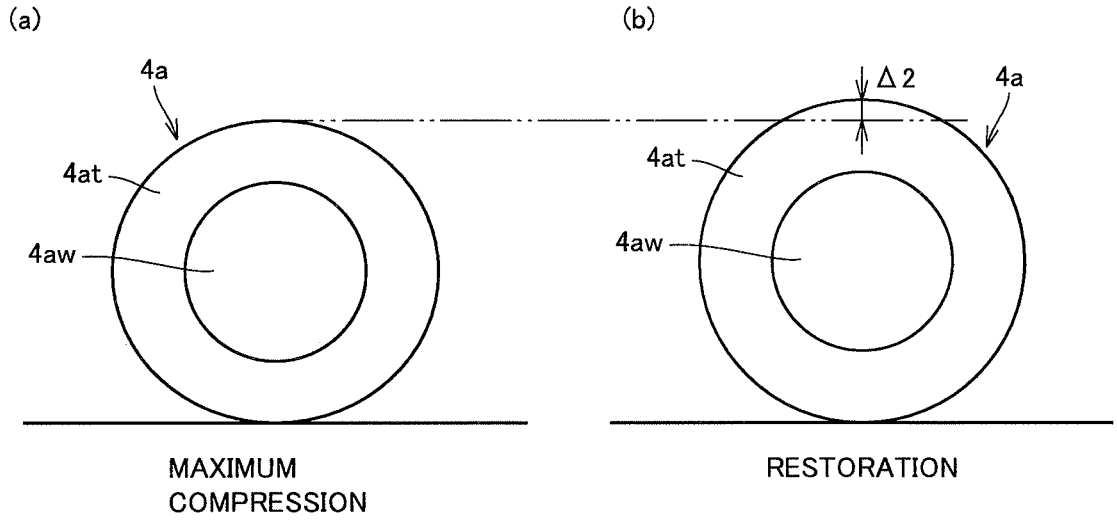
FIG. 12 is a schematic diagram showing restoration of a shape of a tire which has deformed as being compressed.

FIG. 12 is a schematic diagram showing restoration of a shape of tire 4*at* which has deformed as being compressed. FIG. 12 (*a*) is a diagram schematically showing front wheel 4*a* of which amount of compression in the vertical direction is maximum and FIG. 12 (*b*) is a diagram schematically showing front wheel 4*a* of which compression has been released and amount of deflection in the vertical direction has decreased. As compared with the tire in FIG. 12 (*a*), tire 4*at* shown in FIG. 12 (*b*) is greater in dimension in the vertical direction orthogonal to the ground surface by a dimension Δ2 shown in the figure. FIG. 12 (*a*) shows a state of tire 4*at* at time t2. FIG. 12 (*b*) shows a state of tire 4*at* at time t3.

In wheel loader 1 based on the present embodiment, tire 4*at* of front wheel 4*a* compressed in the vertical direction from time t0 to time t2 thereafter rebounds and stretches in the vertical direction from time t2 to time t5. With stretching of tire 4*at*, the front portion of vehicular body 2 moves upward. In control of wheel loader 1 in the present embodiment, upward movement of the front end of vehicular body 2 from time t2 to time t5 is made use of for a work for raising boom 6.

With upward movement of the front portion of vehicular body 2, boom 6 attached to vehicular body 2 by boom pin 16 is also moved upward. During a period in which boom 6 is moved upward together with vehicular body 2, raising of boom 6 by drive of lift cylinders 14*a* and 14*b* is started. Force for lifting boom 6 generated by an operation of lift cylinders 14*a* and 14*b* is assisted by upward movement of boom 6 as a result of rebound of tire 4*at*. Thus, drive force of lift cylinders 14*a* and 14*b* required for an operation to raise boom 6 to a desired height can be reduced. Therefore, fuel efficiency in a work for raising boom 6 can be improved.

<Configuration of Control System>

Figure 13:
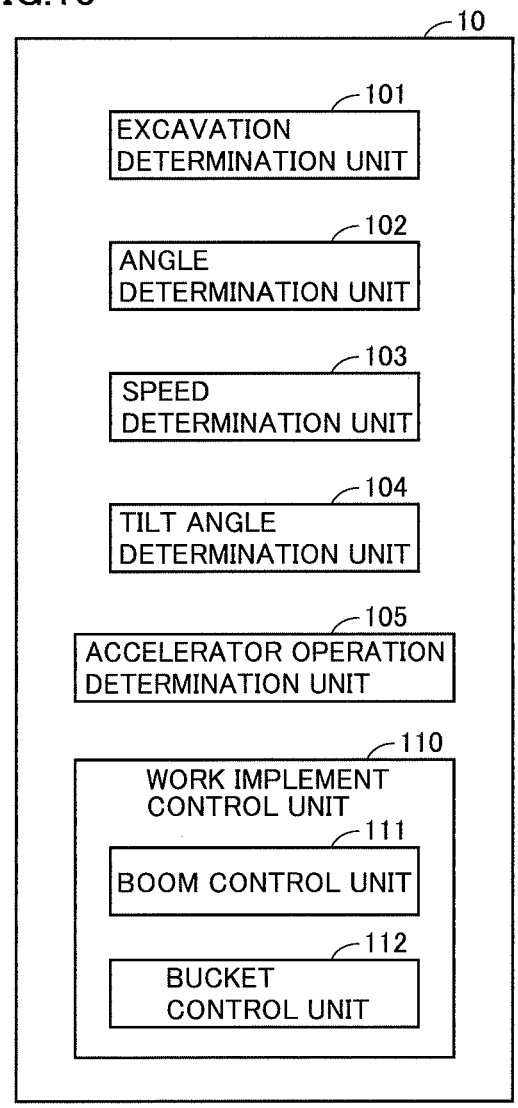
FIG. 13 is a diagram illustrating a functional configuration of a control unit of the wheel loader based on the embodiment.

FIG. 13 is a diagram illustrating a functional configuration of control unit 10 of wheel loader 1 based on the embodiment. As shown in FIG. 13, control unit 10 includes an excavation determination unit 101, an angle determination unit 102, a speed determination unit 103, a tilt angle determination unit 104, an accelerator operation determination unit 105, and a work implement control unit 110.

Excavation determination unit 101 determines whether or not excavation is being performed. For example, excavation determination unit 101 obtains a detection signal associated with a position of transmission operation member 85*a* from transmission operation detection unit 85*b* shown in FIG. 2 and obtains a detection signal associated with a position of FR operation member 86*a* from FR operation detection unit 86*b*. Excavation determination unit 101 determines to which of four forward drive velocity stages F1 to F4 and two reverse drive velocity stages R1 and R2 shown in FIG. 6 a currently selected velocity stage of transmission 26 has been set based on these detection signals.

Excavation determination unit 101 obtains a detection signal associated with a position of boom operation member 83*a* from boom operation detection unit 83*b* shown in FIG. 2. Excavation determination unit 101 determines a type of a current operation (float, lowering, neutral, or raising) of boom 6 based on the detection signal.

Excavation determination unit 101 obtains a detection signal associated with a position of bucket operation member 84*a* from bucket operation detection unit 84*b* shown in FIG. 2. Excavation determination unit 101 determines a type of a current operation (dump, neutral, or tilt) of bucket 7 based on the detection signal.

Excavation determination unit 101 obtains a detection signal associated with a pressure of the hydraulic oil supplied to lift cylinders 14*a* and 14*b* from second hydraulic sensor 95 shown in FIG. 2. Excavation determination unit 101 determines a current hydraulic pressure of the cylinder bottom chamber of lift cylinders 14*a* and 14*b* based on the detection signal.

As described above with reference to FIG. 6, excavation determination unit 101 determines whether or not a currently performed step is the excavation step based on a combination of the current velocity stage, the type of the operation of the boom, the type of the operation of the bucket, and the hydraulic pressure of the lift cylinder. Angle determination unit 102 obtains a detection signal associated with an angle in the pitch direction around center of gravity G of vehicular body 2 from angle detection unit 44 shown in FIGS. 1 and 2. Angle determination unit 102 determines an orientation of the current pitch angle of vehicular body 2 with respect to center of gravity G based on the detection signal and determines increase or decrease in pitch angle.

Speed determination unit 103 obtains a detection signal associated with a speed in the pitch direction around center of gravity G of vehicular body 2 from speed detection unit 46 shown in FIGS. 1 and 2. Speed determination unit 103 determines an orientation of movement of the front end of vehicular body 2 with respect to center of gravity G of vehicular body 2 based on the detection signal and makes determination as to comparison between a speed of upward movement and prescribed threshold value Tv (see FIG. 11 (*c*)).

Tilt angle determination unit 104 obtains a detection signal associated with tilt angle β (see FIG. 3) from tilt angle detection unit 99 shown in FIG. 2. Tilt angle determination unit 104 determines increase or decrease in tilt angle β based on the detection signal and determines whether or not bucket 7 is performing a tilt operation.

Accelerator operation determination unit 105 obtains a detection signal associated with the amount of operation of the accelerator from accelerator operation detection unit 81*b* shown in FIG. 2. Accelerator operation determination unit 105 determines increase or decrease in the amount of operation of the accelerator based on the detection signal and determines increase or decrease in traveling drive force for moving vehicular body 2 forward.

Work implement control unit 110 has a boom control unit 111 and a bucket control unit 112. Boom control unit 111 generates a control command to lift cylinders 14*a* and 14*b* shown in FIG. 2 and outputs the control command to work implement control valve 34. Bucket control unit 112 generates a control command to tilt cylinder 15 shown in. FIG. 2 and outputs the control command to work implement control valve 34. Thus, work implement control valve 34 is controlled, lift cylinders 14*a* and 14*b* and tilt cylinder 15 extend and contract, and boom 6 and bucket 7 operate.

Figure 14:
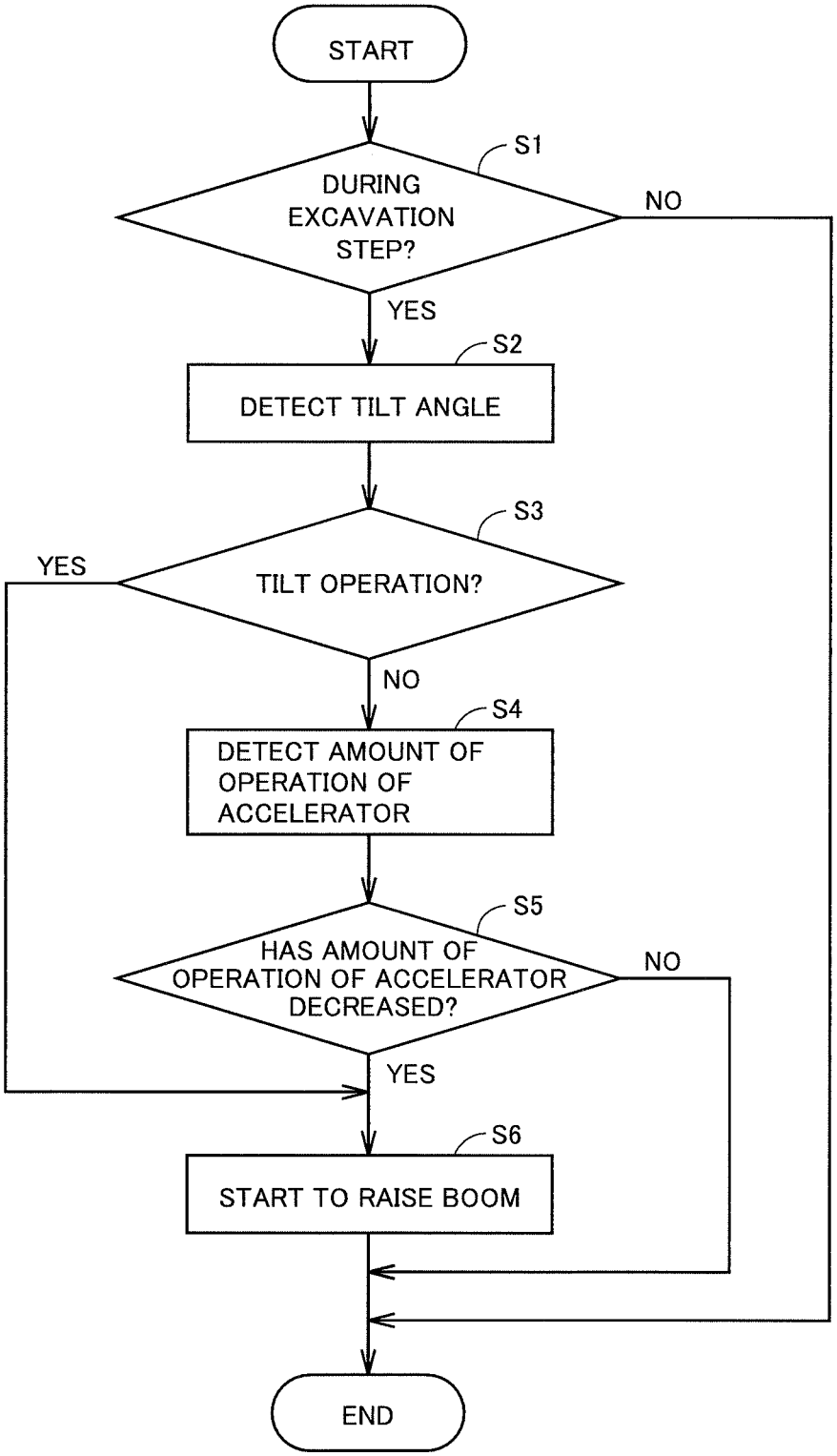
FIG. 14 is a flowchart illustrating a first example of a flow of processing by the control unit based on the embodiment.

FIG. 14 is a flowchart illustrating a first example of a flow of processing by control unit 10 based on the embodiment. As shown in FIG. 14, control unit 10 determines in step S1 whether or not the excavation step is being performed. Specifically, excavation determination unit 101 determines whether or not the currently performed step is the excavation step based on a combination of the current velocity stage, the type of the operation of the boom, the type of the operation of the bucket, and the hydraulic pressure of the lift cylinder.

When determination as the excavation step is made (YES in step S1), control unit 10 detects tilt angle β in step S2. Specifically, tilt angle determination unit 104 calculates current tilt angle β based on a detection signal obtained from tilt angle detection unit 99. Tilt angle determination unit 104 similarly calculates tilt angle β a unit time before the current time point based on a detection signal obtained from tilt angle detection unit 99 the unit time before. Tilt angle determination unit 104 compares current tilt angle β with tilt angle β the unit time before. A person skilled in the art could change design of a length of the unit time as appropriate.

Control unit 10 determines in step S3 whether or not bucket 7 is performing a tilt operation. Specifically, when current tilt angle β is the same as tilt angle β the unit time before, angle determination unit 104 determines that bucket 7 has not moved relatively to boom 6 and is not performing the tilt operation. When current tilt angle β is smaller than tilt angle β the unit time before, tilt angle determination unit 104 determines that bucket 7 is performing a dumping operation and is not performing the tilt operation. When current tilt angle β is greater than tilt angle β the unit time before, tilt angle determination unit 104 determines that bucket 7 is performing the tilt operation.

When it is determined that bucket 7 is not performing the tilt operation (NO in step S3), control unit 10 detects the amount of operation of the accelerator in step S4. Specifically, accelerator operation determination unit 105 calculates a current amount of operation of the accelerator based on a detection signal obtained from accelerator operation detection unit 81*b*. Accelerator operation determination unit 105 similarly calculates an amount of operation of the accelerator a unit time before the current time point based on a detection signal obtained from accelerator operation detection unit 81*b* the unit time before. Accelerator operation determination unit 105 compares the current amount of operation of the accelerator with the amount of operation of the accelerator the unit time before.

Control unit 10 determines in step S5 whether or not the amount of operation of the accelerator has decreased. Specifically, when the current amount of operation of the accelerator is the same as or greater than the amount of operation of the accelerator the unit time before, accelerator operation determination unit 105 determines that the amount of operation of the accelerator has not decreased. When the current amount of operation of the accelerator is smaller than the amount of operation of the accelerator the unit time before, accelerator operation determination unit 105 determines that the amount of operation of the accelerator has decreased.

When it is determined in step S3 that bucket 7 is performing the tilt operation (YES in step S3) and when it is determined in step S5 that the amount of operation of the accelerator has decreased (YES in step S5), control unit 10 starts to raise boom 6 in step S6. Specifically, boom control unit 111 outputs a control command to work implement control valve 34 to supply the hydraulic oil to the cylinder bottom chamber of lift cylinders 14*a* and 14*b* and extend lift cylinders 14*a* and 14*b*. Boom 6 thus starts to move upward. Then, the process ends (end).

When it is determined in step S1 that the excavation step is not being performed (NO in step S1) and when it is determined in step S5 that the amount of operation of the accelerator has not decreased (NO in step S5), control unit 10 skips step S6. Therefore, boom 6 is not raised. Then, the process ends (end).

Through the processing, after the tilt operation of bucket 7 is detected or decrease in the amount of operation of the accelerator for accelerating vehicular body 2 is detected, raising of boom 6 is started. With the tilt operation of bucket 7 or decrease in the amount of operation of the accelerator, a component of force applied to bucket 7 in the direction shown with arrow B in FIG. 8 decreases and moment M around center of gravity G of vehicular body 2 shown in FIG. 9 decreases. Thus, compression in the vertical direction of tire 4*at* of front wheel 4*a* is released. Tire 4*at* of which compression has been released rebounds and stretches in the vertical direction. With stretching of tire 4*at*, the front portion of vehicular body 2 moves upward.

Therefore, since raising of boom 6 can be started while boom 6 moves upward together with vehicular body 2, drive force of lift cylinders 14*a* and 14*b* required for an operation to raise boom 6 can be reduced. Therefore, fuel efficiency in a work for raising boom 6 can be improved.

Figure 15:
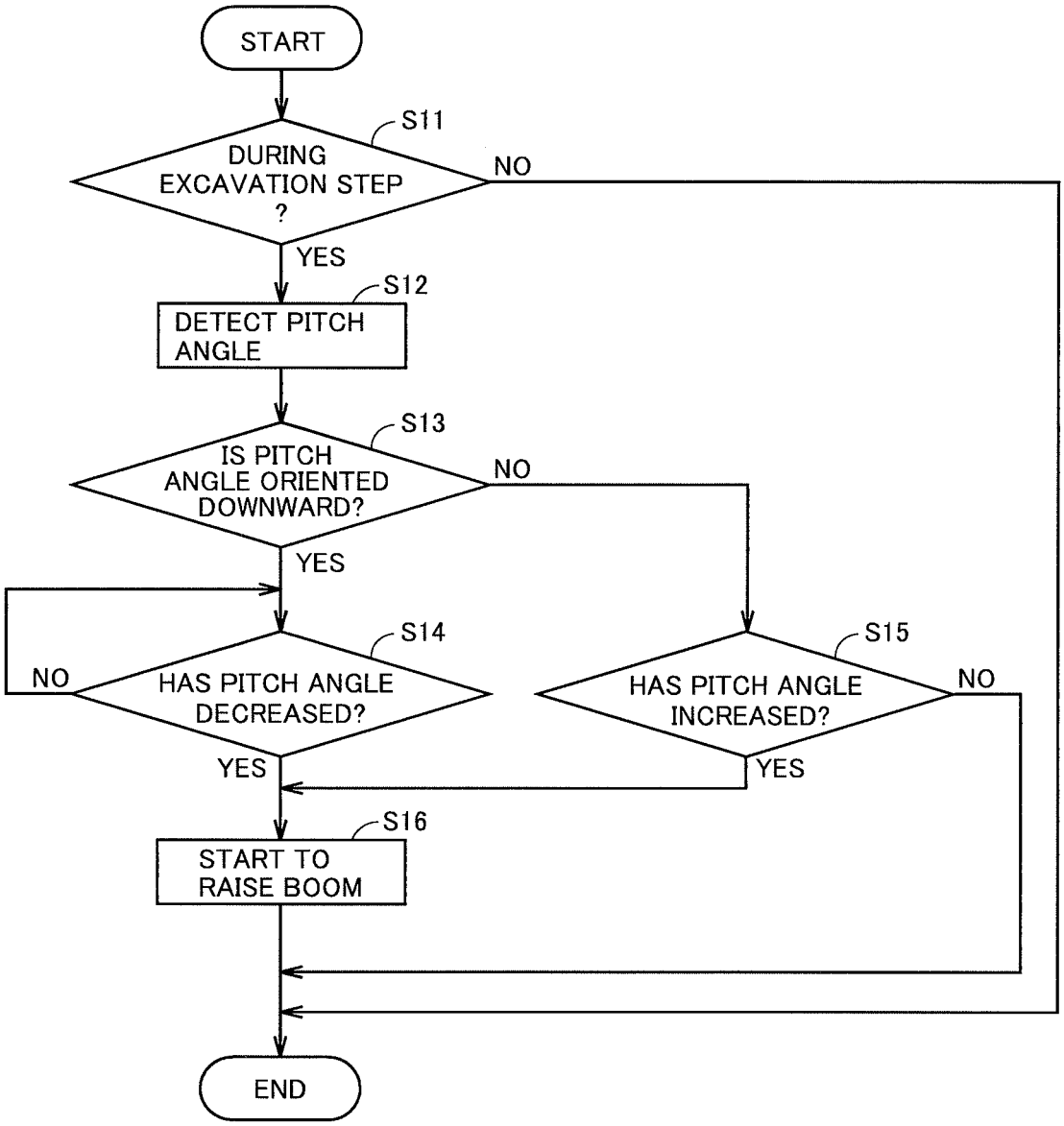
FIG. 15 is a flowchart illustrating a second example of the flow of processing by the control unit based on the embodiment.

FIG. 15 is a flowchart illustrating a second example of the flow of processing by control unit 10 based on the embodiment. As shown in FIG. 15, control unit 10 determines in step S11 whether or not the excavation step is being performed. Specifically, excavation determination unit 101 determines whether or not a currently performed step is the excavation step based on a combination of the current velocity stage, the type of the operation of the boom, the type of the operation of the bucket, and the hydraulic pressure of the lift cylinder.

When determination as the excavation step is made (YES in step S11), control unit 10 detects pitch angle θ in step S12.

Specifically, angle determination unit 102 calculates current pitch angle θ based on a detection signal obtained from angle detection unit 44. Angle determination unit 102 similarly calculates pitch angle θ a unit time before the current time point based on a detection signal obtained from angle detection unit 44 the unit time before. Angle determination unit 102 compares current pitch angle θ with pitch angle θ the unit time before.

Control unit 10 determines in step S13 whether or not pitch angle θ is oriented downward. Specifically, when current pitch angle θ is within the negative range on the ordinate shown in the graph in FIG. 11 (*b*), angle determination unit 102 determines that the front end of vehicular body 2 has been displaced downward with respect to center of gravity G and pitch angle θ is oriented downward. When current pitch angle θ is within the positive range or at zero on the ordinate shown in the graph in FIG. 11 (*b*), it determines that pitch angle θ is not oriented downward.

When it is determined in step S13 that pitch angle θ is oriented downward (YES in step S13), control unit 10 determines in step S14 whether or not pitch angle θ has decreased. Specifically, when current pitch angle θ is equal to or greater than pitch angle θ the unit time before, angle determination unit 102 determines that pitch angle θ has not decreased. When current pitch angle θ is smaller than pitch angle θ the unit time before, angle determination unit 102 determines that pitch angle θ has decreased.

"Pitch angle θ" refers to magnitude of inclination of vehicular body 2. As an angle of inclination of vehicular body 2 is greater, pitch angle θ is greater. When vehicular body 2 is inclined in such a direction that the front end of vehicular body 2 is oriented downward with respect to center of gravity G (counterclockwise in the left side view shown in FIG. 9), pitch angle θ is greater as the front end of vehicular body 2 is closer to the ground. When vehicular body 2 is inclined in such a direction that the front end of vehicular body 2 is oriented upward with respect to center of gravity G (clockwise in the left side view shown in FIG. 9), pitch angle θ is greater as the front end of vehicular body 2 is farther from the ground. As pitch angle θ is more distant from a value of zero on the ordinate in the graph in FIG. 11 (*b*), pitch angle θ is greater.

When it is determined in step S14 that pitch angle θ has not decreased (NO in step S14), determination in step S14 is repeated. While pitch angle θ oriented downward has not decreased (is maintained at a constant value or has increased), the front portion of vehicular body 2 is moving downward with respect to the center of gravity owing to moment M around center of gravity G of vehicular body 2 shown in FIG. 9 and an angle of forward inclination of vehicular body 2 monotonously increases. During this period, boom 6 is not raised.

When it is determined in step S13 that pitch angle θ is not oriented downward (NO in step S13), control unit 10 determines in step S15 whether or not pitch angle θ has increased. Specifically, when current pitch angle θ is equal to or smaller than pitch angle θ the unit time before, angle determination unit 102 determines that pitch angle θ has not increased. When current pitch angle θ is greater than pitch angle θ the unit time before, angle determination unit 102 determines that pitch angle θ has increased.

When it is determined in step S14 that pitch angle θ has decreased (YES in step S14) and when it is determined in step S15 that pitch angle θ has increased (YES in step S15), control unit 10 starts to raise boom 6 in step S16. Specifically, boom control unit 111 outputs a control command to work implement control valve 34 to supply the hydraulic oil to the cylinder bottom chamber of lift cylinders 14*a* and 14*b* and extend lift cylinders 14*a* and 14*b*. Raising of boom 6 is thus started. Then, the process ends (end).

When determination as the excavation step is not made in step S11 (NO in step S11) and when it is determined in step S15 that pitch angle θ has not increased (NO in step S15), control unit 10 skips step S16. Therefore, boom 6 is not raised. Then, the process ends (end).

Through the processing, after start of upward movement of the front portion of vehicular body 2 with respect to center of gravity G is determined based on a detection signal obtained from angle detection unit 44, raising of boom 6 is started. As tire 4*at* of front wheel 4*a* compressed in the vertical direction rebounds and stretches in the vertical direction, the front portion of vehicular body 2 moves upward with respect to center of gravity G. During a period in which boom 6 moves upward together with vehicular body 2, raising of boom 6 is started. Therefore, drive force of lift cylinders 14*a* and 14*b* required for an operation to raise boom 6 can be reduced and fuel efficiency in a work for raising boom 6 can be improved.

Figure 16:
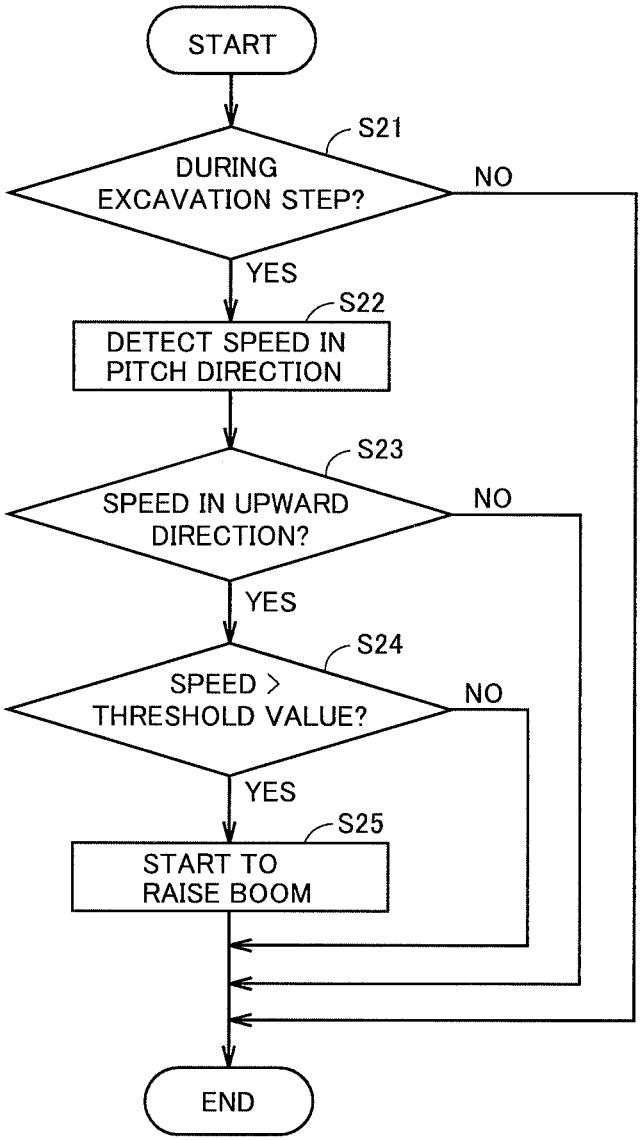
FIG. 16 is a flowchart illustrating a third example of the flow of processing by the control unit based on the embodiment.

FIG. 16 is a flowchart illustrating a third example of the flow of processing by control unit 10 based on the embodiment. As shown in FIG. 16, control unit 10 determines in step S21 whether or not the excavation step is being performed. Specifically, excavation determination unit 101 determines whether or not a currently performed step is the excavation step based on a combination of the current velocity stage, the type of the operation of the boom, the type of the operation of the bucket, and the hydraulic pressure of the lift cylinder.

When determination as the excavation step is made (YES in step S21), control unit 10 detects in step S22 a speed in the pitch direction around the center of gravity of vehicular body 2. Specifically, speed determination unit 103 determines whether an orientation of movement of the front end of vehicular body 2 with respect to center of gravity G of vehicular body 2 is upward or downward based on a detection signal obtained from speed detection unit 46 and calculates a speed of that movement of vehicular body 2.

Control unit 10 determines in step S23 whether or not the speed in the pitch direction around the center of gravity of vehicular body 2 is in an upward orientation.

When it is determined in step S23 that the speed in the pitch direction of vehicular body 2 is in the upward direction (YES in step S23), the control unit determines in step S24 whether or not the speed in the pitch direction of vehicular body 2 is higher than prescribed threshold value Tv (see FIG. 11 (*c*)).

When it is determined in step S24 that the speed in the pitch direction of vehicular body 2 is higher than threshold value Tv (YES in step S23), control unit 10 starts to raise boom 6 in step S25. Specifically, boom control unit 111 outputs a control command to work implement control valve 34 to supply the hydraulic oil to the cylinder bottom chamber of lift cylinders 14*a* and 14*b* and extend lift cylinders 14*a* and 14*b*. Raising of boom 6 is thus started. Then, the process ends (end).

When determination as the excavation step is not made in step S21 (NO in step S21), when it is determined in step S23 that the speed in the pitch direction around the center of gravity of vehicular body 2 is not in the upward direction (NO in step S23), and when it is determined in step S24 that the speed in the pitch direction of vehicular body 2 is equal to or lower than threshold value Tv (NO in step S24), control unit 10 skips step S25. Therefore, boom 6 is not raised. Then, the process ends (end).

Through the processing, during a period in which the speed of upward movement of the front portion of vehicular body 2 with respect to center of gravity G is higher than threshold value Tv, raising of boom 6 is started. As tire 4*at* of front wheel 4*a* compressed in the vertical direction rebounds and stretches in the vertical direction, the front portion of vehicular body 2 moves upward with respect to center of gravity G. During a period in which boom 6 moves upward together with vehicular body 2 and the speed of that movement is higher than prescribed threshold value Tv, raising of boom 6 is started. Therefore, drive force of lift cylinders 14*a* and 14*b* required for an operation to raise boom 6 can be reduced and fuel efficiency in a work for raising boom 6 can be improved.

In the present example, raising of boom 6 is started during a period in which the speed is higher than threshold value Tv. Raising of boom 6 may be started by the time when the speed in the pitch direction of vehicular body 2 attains to the maximum (time t4 shown in FIG. 11 (*c*)), and for example, raising of boom 6 may be started between time t2 and time t4 shown in FIG. 11 (*c*).

Control for starting to raise boom 6 during a period in which tire 4*at* compressed in the vertical direction rebounds and stretches in the vertical direction is described in the embodiment. Without being limited as such, display 50 may show appropriate timing of operation of boom operation member 83*a* by the operator for starting to raise boom 6 in the excavation step. By doing so, the operator can operate work implement 3 in accordance with operation guidance shown on display 50 and hence an inexperienced operator can efficiently learn operations by a skilled operator.

Though an embodiment of the present invention has been described above, it should be understood that the embodiment disclosed herein is illustrative and non-restrictive in every respect. The scope of the present invention is defined by the terms of the claims and is intended to include any modifications within the scope and meaning equivalent to the terms of the claims.

REFERENCE SIGNS LIST

1 wheel loader; 2 vehicular body; 2*a* front vehicular body portion; 2*b* rear vehicular body portion; 3 work implement; 4*a* front wheel; 4*at*, 4*bt* tire; 4*aw*, 4*bw* wheel portion; 4*b* rear wheel; 5 operator's cab; 6 boom; 7 bucket; 7*a* cutting edge; 10 control unit; 14*a*, 14*b* lift cylinder; 15 tilt cylinder; 16 boom pin; 17 bucket pin; 21 engine; 44 angle detection unit; 46 speed detection unit; 50 display; 81*a* accelerator operation member; 81*b* accelerator operation detection unit; 83*a* boom operation member; 83*b* boom operation detection unit; 84*a* bucket operation member; 84*b* bucket operation detection unit; 98 boom angle detection unit; 99 tilt angle detection unit; 101 excavation determination unit; 102 angle determination unit; 103 speed determination unit; 14 tilt angle determination unit; 105 accelerator operation determination unit; 110 work implement control unit; 111 boom control unit; and 112 bucket control unit

The invention claimed is:

1. A wheel loader comprising:

a vehicular body;

a work implement which is disposed in front of the vehicular body and has a boom and a lift cylinder, the boom configured to be raised and lowered by operation of the lift cylinder;

a front wheel which has a tire made of an elastic material; and a control unit configured to:

determine, based on receiving a signal indicative of the tire stretching in a vertical direction, stretching of the tire in the vertical direction when the tire is rebounding after being compressed in the vertical direction, and output a control command to the lift cylinder to start to raise the boom when it is determined that the tire is stretching in the vertical direction due to the tire rebounding after being compressed in the vertical direction.

2. The wheel loader according to claim 1, wherein the control unit is configured to:

determine, based on receiving a signal indicative of an excavating state of the wheel loader, whether excavation is being performed by the wheel loader, and output the control command to the lift cylinder to start to raise the boom when it is determined that both excavation is being performed by the wheel loader and the tire is stretching in the vertical direction due to the tire rebounding after being compressed in the vertical direction.

3. The wheel loader according to claim 1, wherein the control unit is configured to:

determine, based on receiving a signal indicative of a pitch angle, an angle in the pitch direction around a center of gravity of the vehicular body, determine, based on the angle in the pitch direction around the center of gravity of the vehicular body, a start of upward movement of a front portion of the vehicular body, and output the control command to the lift cylinder to start to raise the boom when it is determined that both the front portion of the vehicular body has started upward movement and the tire is stretching in the vertical direction due to the tire rebounding after being compressed in the vertical direction.

4. The wheel loader according to claim 1, wherein the control unit is configured to:

determine, based on receiving a signal indicative of an upward movement of the front portion of the vehicular body, whether a speed of upward movement of a front portion of the vehicular body is higher than a threshold value, and output the control command to the lift cylinder to start to raise the boom when it is determined that both the speed of upward movement of the front portion of the vehicular body is higher than the threshold value and the tire is stretching in the vertical direction due to the tire rebounding after being compressed in the vertical direction.

5. The wheel loader according to claim 1, wherein the work implement further has a bucket, and the control unit is configured to:

determine, based on receiving a signal indicative of a tilt operation of the bucket, the tilt operation of the bucket, and output the control command to the lift cylinder to start to raise the boom when it is determined that both the bucket is operated to tilt and the tire is stretching in the vertical direction due to the tire rebounding after being compressed in the vertical direction.

6. The wheel loader according to claim 1, wherein the control unit is configured to:

determine, based on a received signal indicative of an accelerator operation, an amount of operation of an accelerator for accelerating the vehicular body, and output the control command to the lift cylinder to start to raise the boom when it is determined that both the amount of operation of the accelerator has decreased and the tire is stretching in the vertical direction due to the tire rebounding after being compressed in the vertical direction.

7. The wheel loader according to claim 1, wherein a first end of the lift cylinder is attached to the vehicular body and a second end of the lift cylinder is attached to the boom.

8. The wheel loader according to claim 5, wherein the work implement further has a tilt cylinder, and the bucket swings with respect to the boom by extension and contraction of the tilt cylinder.

* * * * *